US006166714A

United States Patent [19]

Kishimoto

[11] Patent Number: 6,166,714

[45] Date of Patent: Dec. 26, 2000

[54] DISPLAYING DEVICE

[75] Inventor: Tomoji Kishimoto, Hyogo-ken, Japan

[73] Assignee: Kabushiki Kaisha Toshiba, Kawasaki, Japan

[21] Appl. No.: 08/870,713

[22] Filed: Jun. 6, 1997

[30] Foreign Application Priority Data

Jun. 6, 1996 [JP] Japan ..... 8-144530

[51] Int. Cl.[7] ..... G09G 3/36; G09G 5/00

[52] U.S. Cl. ..... 345/96; 345/209

[58] Field of Search ..... 345/89, 94, 95, 345/96, 97, 98, 99, 100, 208, 209, 210, 87, 103

[56] References Cited

U.S. PATENT DOCUMENTS

| | | | |
|---|---|---|---|
| 5,093,655 | 3/1992 | Tanioka et al. | 345/96 |
| 5,430,460 | 7/1995 | Takabatake et al. | 345/96 |
| 5,640,174 | 6/1997 | Kamei et al. | 345/96 |
| 5,774,099 | 6/1998 | Iwasaki et al. | 345/87 |
| 5,801,674 | 9/1998 | Shimuzu | 345/103 |

*Primary Examiner*—Matthew Luu
*Assistant Examiner*—Anthony J. Blackman
*Attorney, Agent, or Firm*—Pillsbury Madison & Sutro LLP

[57] ABSTRACT

A displaying device includes an array substrate on which a plurality of pixel electrodes are arrayed, a counter substrate having a common electrode arranged to oppose the pixel electrodes on the array substrate, a liquid crystal cell held between the array substrate and the counter substrate, and a display control circuit for controlling the potential difference between each pixel electrode and a common electrode to periodically invert the direction of an electric field in the liquid crystal cell. Particularly, the display control circuit includes an X-driver for level-inverting a pixel signal voltage (VSIG) of a first amplitude every predetermined period and supplying the pixel signal voltage to each pixel electrode to set a display gray scale level, and a common electrode driver for level-inverting a common voltage (VCOM) of a second amplitude in synchronism with level inversion of the pixel signal voltage (VSIG) and supplying the common voltage to the common electrode. The second amplitude is determined to be smaller than the first amplitude not exceeding the range from the minimum level to the maximum level of the pixel signal voltage (VSIG).

10 Claims, 6 Drawing Sheets

DISPLAYING DEVICE

BACKGROUND OF THE INVENTION

The present invention relates to a displaying device in which a pixel signal voltage is periodically level-inverted together with a common voltage.

In recent years, flat-panel displaying devices represented by liquid crystal displaying devices have been widespread because of their advantages including thin profile, light weight, and low power consumption. A typical liquid crystal displaying device has a structure in which a liquid crystal composition is held between an array substrate and a counter substrate. Each of the array and counter substrates has a dielectric and light-transmitting property. A liquid crystal cell is formed by filling the liquid crystal composition in the gap between the array and counter substrates. The array substrate has a matrix array of pixel electrodes, scanning lines formed along the rows of pixel electrodes, signal lines formed along the columns of pixel electrodes, and a first alignment film entirely covering the matrix array of pixel electrodes. The scanning lines are provided for respectively selecting the rows of the pixel electrodes, and the signal lines are provided for applying a pixel signal voltage to the pixel electrodes of a selected row. The counter substrate has a common electrode opposed against the matrix array of pixel electrodes, and a second alignment film entirely covering the common electrode. The first and second alignment films are provided for causing liquid crystal molecules within the liquid crystal cell to be in a twisted nematic (TN) alignment when no potential difference is present between the pixel electrodes and the common electrode. When light is incident on the liquid crystal layer from one substrate side through a polarizing plate, the light is rotated along the liquid crystal molecules which are herically twisted in the direction of thickness of the liquid crystal layer and guided to the other substrate at which it is selectively transmitted through another polarizing plate. When a potential difference is created between the pixel electrode and the common electrode, the liquid crystal molecules are tilted up, from a plane parallel to the substrate surface on which an image is displayed, by an angle proportional to the potential difference, thereby changing the light transmittance.

In an active matrix liquid crystal displaying device, a plurality of thin film transistors (TFTS) are formed near the intersections of scanning lines and signal lines and used as switching elements for selectively driving the corresponding pixel electrodes. The gate of each TFT is connected to one scanning line, the drain is connected to one signal line, and the source is connected to one pixel electrode. The TFT is turned on in response to rising of a scanning pulse from the scanning line and supplies a pixel signal voltage from the signal line to the pixel electrode. The pixel electrode and the common electrode constitute a liquid crystal capacitance CLC which is charged in accordance with the potential difference between the electrodes. This potential difference is maintained by the liquid crystal capacitance CLC even after the TFT is turned off in response to falling of the scanning pulse.

However, when an electric field is always applied in the same direction, materials other than the liquid crystal are concentrated on one electrode side to shorten the service life of the liquid crystal cell. As a conventionally known technique of solving this problem, the polarity of the pixel signal voltage is inverted every frame period using the potential of the common electrode as a reference. In some cases, polarity inversion of the pixel signal voltage is performed every horizontal scanning period in order to reduce flicker. Recently, for the purpose of reducing the amplitude of the pixel signal voltage necessary for the above-described polarity inversion, the common electrode potential is positively shifted by a common voltage applied from a common electrode driver. In this case, the pixel signal voltage VSIG is level-inverted using the center level of the amplitude (0V to +5V) as a reference, and a common voltage VCOM is level-inverted from one of a high level VCOMH (=+5.2V) and a low level VCOML (=−0.2V) to the other in synchronism with level inversion of the pixel signal voltage VSIG, as shown in FIG. 9.

Conventionally, the common electrode driver obtains two stable power source voltage levels equal to the high level VCOMH and the low level VCOML from a DC/DC converter. However, this DC/DC converter has a complex structure since it must also generate a stable power source voltage level used for obtaining the pixel signal voltage VSIG. This makes it difficult to manufacture the liquid crystal displaying device at a low cost.

When a displaying device of a large size is manufactured, the common electrode requires an area increased in proportion to the number of pixel electrodes. Since the common electrode is constituted by a conductive thin film of Indium Tin Oxide or the like having a relatively high resistance, an increase in the load on the common voltage VCOM of the above-mentioned amplitude which drives the common electrode cannot be prevented.

BRIEF SUMMARY OF THE INVENTION

It is an object of the present invention to provide a displaying device capable of easily reducing flicker in a large-size displaying device. It is another object of the present invention to provide a displaying device capable of reducing the required number of stable power source voltage levels.

According to the first aspect of the present invention, there is provided a displaying device comprising an array substrate on which a plurality of pixel electrodes are arrayed, a common electrode arranged in associated with the pixel electrodes, an optical modulation layer set to have an optical modulation ratio corresponding to a potential difference between each pixel electrode and the common electrode, and a display control circuit for controlling the potential difference between each pixel electrode and the common electrode, wherein the display control circuit includes a pixel electrode driving unit for supplying a pixel signal voltage to each pixel electrode to set a display gray scale level every predetermined period, and a common electrode driving unit for supplying a common voltage of an amplitude smaller than that of the pixel signal voltage to the common electrode every predetermined period.

According to the second aspect of the present invention, there is provided a displaying device comprising an array substrate on which a plurality of pixel electrodes are arrayed, a common electrode arranged in association with the pixel electrodes, an optical modulation layer set to have an optical modulation ratio corresponding to a potential difference between each pixel electrode and the common electrode, and a display control circuit for controlling the potential difference between each pixel electrode and the common electrode such that the direction of an electric field in the optical modulation layer is periodically inverted, wherein the display control circuit includes a pixel electrode driving unit for level-inverting a pixel signal voltage of a first amplitude every predetermined period to set a display gray scale level and supplying the pixel signal voltage to each pixel electrode, and a common electrode driving unit for level-inverting a common voltage of a second amplitude smaller than the first amplitude within a range from a minimum level to a maximum level of the pixel signal voltage in synchronism with level inversion of the pixel signal voltage, and supplying the common voltage to the common electrode.

In the displaying device according to the first aspect, the amplitude of the common voltage is determined to be smaller than that of the pixel signal voltage. With this determination, it is possible to reduce the power consumption and distortion in the common voltage waveform. This distortion in the commoi voltage waveform tends to be easily generated when the load on the common electrode driving unit increases due to an increase in size of the displaying device. However, when the amplitude of the common voltage is small, the common voltage can smoothly transit from one of the minimum level and the maximum level to the other.

In the displaying device according the second aspect, the common voltage is determined to have an amplitude smaller than the first amplitude within the range from the minimum level to the maximum level of the pixel signal voltage and level-inverted in synchronism with level inversion of the pixel signal voltage. For this reason, the pixel electrode driving unit and the common electrode driving unit can share a single stable power source voltage to obtain the pixel signal voltage and the common voltage, respectively. Therefore, the required number of stabile power source voltage levels to be supplied from the power source to the display control circuit is decreased, so that the displaying device can be manufactured at a lower cost.

When the first and second amplitudes are determined as described above, the voltage polarity of the difference between the pixel signal voltage and the common voltage can be inverted every predetermined period except when a specific gray scale range including a gray scale level corresponding to the minimum optical modulation ratio is selected for displaying. When the voltage polarity is maintained, the direction of the electric field in the optical modulation layer is not inverted. However, this noninversion of the direction of the electric field occurs at random depending on the change in display gray scale level, and therefore can be maintained at an admissible frequency which does not adversely affect reduction of flicker, by limiting the specific gray scale range. As a result, the amplitude of the common voltage can be determined to be smaller than that in the case where the direction of the electric field in lo the optical modulation layer is inverted over the entire gray scale range.

DETAILED DESCRIPTION OF THE INVENTION

An active matrix liquid crystal displaying device according to an embodiment of the present invention will be described below with reference to the accompanying drawings.

Figure 1:
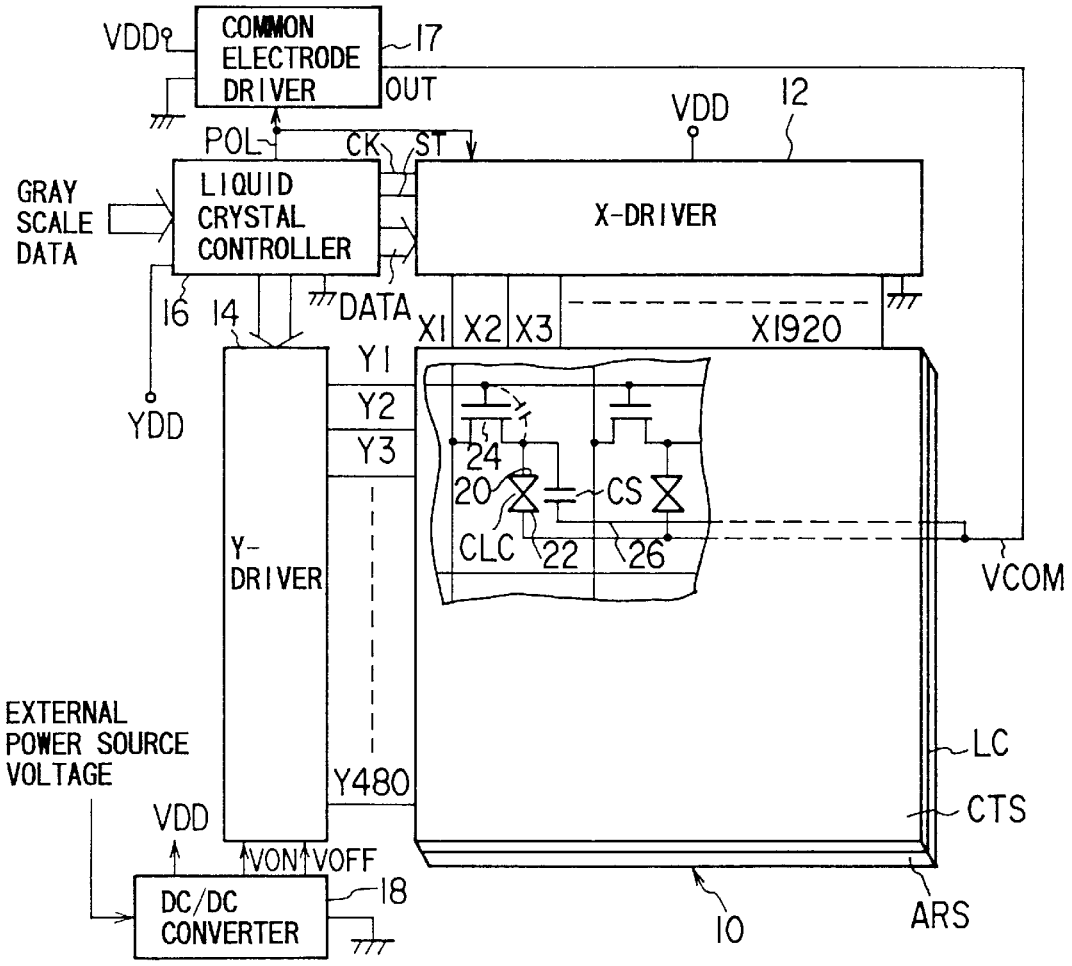
FIG. 1 is a diagram schematically showing the arrangement of an active matrix liquid crystal displaying device according to the first embodiment of the present invention.
Figure 2:
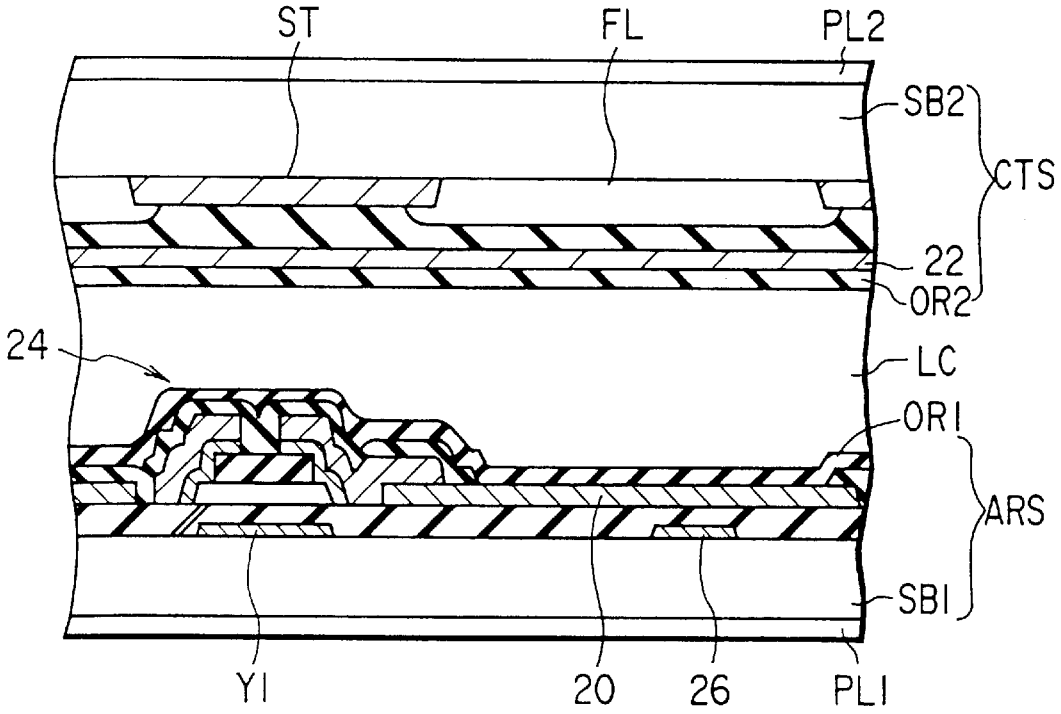
FIG. 2 is a sectional view showing the structure of a liquid crystal panel shown in FIG. 1.

FIG. 1 schematically shows the arrangement of the liquid crystal displaying device. FIG. 2 shows the sectional structure of a liquid crystal panel 10 shown in FIG. 1. The liquid crystal displaying device includes the liquid crystal panel 10 whose a display area has a diagonal size of 12.1 inches and is capable of displaying a color image. The liquid crystal panel 10 is constituted by a transparent array substrate ARS, a transparent counter substrate CTS, and a liquid crystal cell LC held between the array substrate ARS and the counter substrate CTS and having a liquid crystal composition filled inside. In the liquid crystal panel 10, the array substrate ARS has a glass substrate SB1, a matrix array of, e.g., 480×1,920 pixel electrodes 20 formed on the glass substrate SB1, 480 scanning lines Y1 to Y480 respectively formed along the rows of the pixel electrodes 20, 1,920 signal lines X1 to X1920 respectively formed along the columns of the pixel electrodes 20, 480×1,920 thin film transistors (TFTs) 24 formed as switching elements near the intersections of the scanning lines Y1 to Y480 and the signal lines X1 to X1920, 480 storage capacitance lines 26 each formed to overlap the pixel electrodes 20 of the corresponding row through an insulating film, and a first alignment film OR1 entirely covering the matrix array of pixel electrodes 20. The counter substrate CTS has a glass substrate SB2, light-shielding films ST formed on the glass substrate SB2 to mask the peripheries of the pixel electrodes 20, color filters FL for selectively transmitting red, green, and blue light components, a common electrode 22 arranged to oppose the matrix array of pixel electrodes 20, and a second alignment film OR2 entirely covering the common electrode 22. The first alignment film OR1 and the second alignment film OR2 are used for causing liquid crystal molecules to be in a twisted nematic (TN) alignment when no potential difference is present between the pixel electrode 20 and the common electrode 22. Each TFT 24 has a gate connected to one of the scanning lines Y1 to Y480, and a source-drain path connected between one of the signal lines X1 to X1920 and one of the pixel electrodes 20. The pixel electrode 20 and the common electrode 22 constitute a liquid crystal capacitance CLC. The storage capacitance line 26 and the pixel electrode 20 constitute a storage capacitance CS. Two polarizing plates PL1 and PL2 are set to be perpendicular to each other and affixed to the outer surfaces of the array substrate ARS and the counter substrate CTS, respectively. The common electrode 22 is connected to the storage capacitance lines 26.

The liquid crystal displaying device includes a display control circuit connected to the liquid crystal panel 10. This display control circuit has an X-driver 12 for driving the signal lines X1 to X1920, a Y-driver 14 for driving the scanning lines Y1 to Y480, a liquid crystal controller 16 for controlling the X-driver 12 and the Y-driver 14, a common electrode driver 17 for driving the common electrode 22 together with the storage capacitance lines 26, and a DC/DC converter 18 for converting an external power source voltage level to a stable level of +5V, +19V, or −12V. The power source voltage of +5V is applied to a power source terminal VDD connected to the X-driver 12, the liquid crystal controller 16, and the common electrode driver 17. The power source voltages of +19V and −12V are applied to power source terminals VON and VOFF connected to the Y-driver 14.

The liquid crystal controller 16 supplies gray scale data sequentially supplied from an external device to the X-driver 12 together with a start pulse ST and a shift clock CK. A start pulse ST1 is generated every horizontal scanning period during which 1,920 gray scale data are supplied. The shift clock CK is generated each time the gray scale data is supplied. The liquid crystal controller 16 selects one of the scanning lines Y1 to Y480 every horizontal scanning period and supplies the selection result to the Y-driver 14 as a selection signal. A polarity inversion signal POL changes from one of the ground level (=0V) and the VDD level (=+5V) to the other every frame period and every horizontal scanning period to periodically invert the direction of an electric field in the liquid crystal cell LC. The polarity inversion signal POL is supplied from the liquid crystal controller 16 to the X-driver 12 and the common electrode driver 17.

Figure 3:
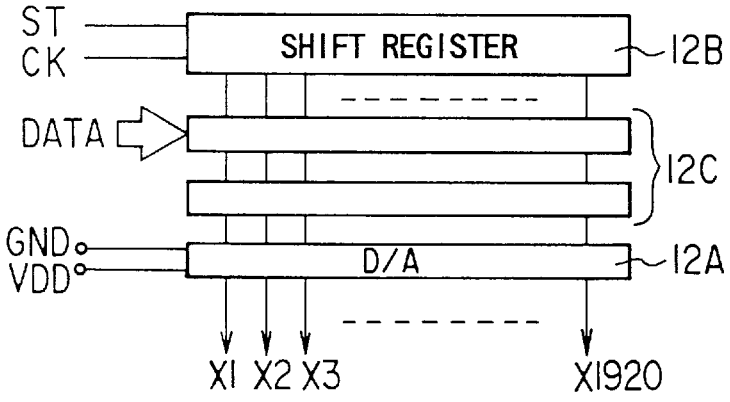
FIG. 3 is a circuit diagram showing the structure of an X-driver shown in FIG. 1.
Figure 4:
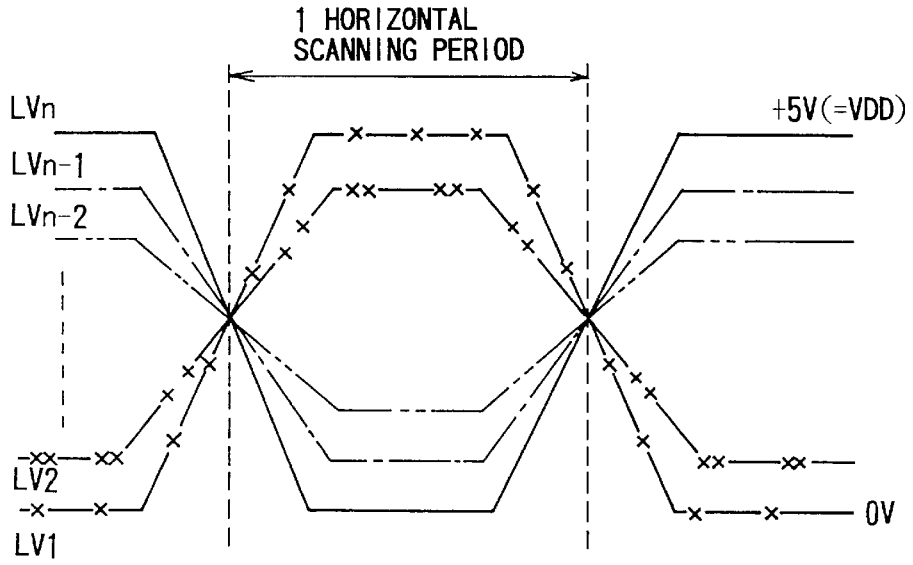
FIG. 4 is a chart showing waveforms so as to explain the operation of a D/A converter shown in FIG. 3.

The X-driver 12 is constituted as shown in FIG. 3 and has a D/A converter 12A for converting gray scale data into a voltage level ranging from the ground level (=0V) to the VDD level (=+5V), a shift register 12B which has 1,920 stages to shift the start pulse ST to subsequent stages in response to the shift clock CK, and latch circuits 12C each for sample-holding the gray scale data in response to the start pulse ST sequentially shifted to the corresponding stage of the shift register 12B. As shown in FIG. 4, a pixel signal voltage VSIG has an amplitude of 5V corresponding to the range from the ground level to the VDD level for gray scale data. In FIG. 4, gray scale data LV1 to LVn (n: positive integer) represent the first gray scale level corresponding to black to the n-th gray scale level corresponding to white, respectively. The actual number of gray scale levels is set at, e.g., 64.

Figure 5:
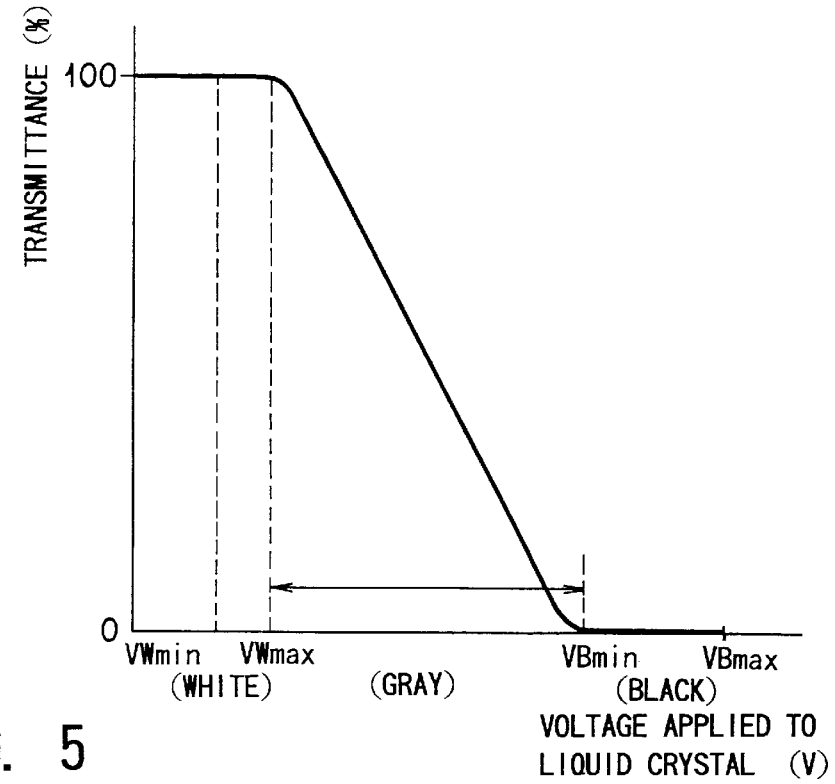
FIG. 5 is a graph showing the relationship between a voltage applied to a liquid crystal and a transmittance in the liquid crystal panel shown in FIG. 1.

When the liquid crystal panel 10 is of a normally white type, the voltage applied to the liquid crystal and the transmittance have a relationship as shown in FIG. 5. The voltage applied to the liquid crystal corresponds to a potential difference between the pixel electrode 20 controlled by the pixel signal voltage VSIG and the common electrode 22 controlled by a common voltage VCOM. The liquid crystal panel 10 has the maximum light transmittance (minimum optical modulation ratio) for white display when the voltage applied to the liquid crystal is set at the minimum level, and the minimum light transmittance (maximum optical modulation ratio) for black display when the voltage applied to the liquid crystal is set at the maximum level. In halftone display, the voltage applied to the liquid crystal is set at an intermediate level between the voltage level corresponding to the maximum light transmittance and the voltage level corresponding to the minimum light transmittance.

The Y-driver 14 sequentially selects the scanning lines Y1 to Y480 in accordance with the selection signal from the liquid crystal controller 16 and supplies a scanning pulse rising from the VOFF level (=−12V) to the VON level (=+19V) to the selected scanning line. At this time, the potentials of unselected scanning lines are maintained at the VOFF level (=−12V).

Each TFT 24 is turned on in response to rising of the scanning pulse from the corresponding scanning line to supply the pixel signal voltage VSIG from the corresponding signal line to the corresponding pixel electrode 20. The liquid crystal capacitance CLC and the storage capacitance CS are charged with the pixel signal voltage VSIG. The TFT 24 is turned off in response to falling of the scanning pulse. However, even after the TFT 24 is turned off, the potential difference between the pixel electrode 20 and the common electrode 22 is maintained by the liquid crystal capacitance CLC and the storage capacitance CS, and updated when the TFT 24 is turned on again after one frame period.

Figure 6:
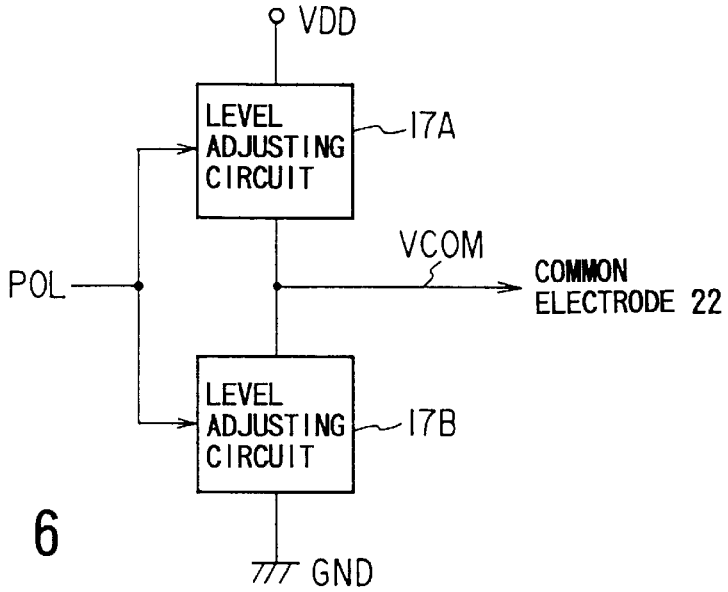
FIG. 6 is a block diagram showing the structure of a common electrode driver shown in FIG. 1.

The common electrode driver 17 supplies the common voltage VCOM having an amplitude of 4V which is smaller than that of the pixel signal voltage VSIG, i.e., 5V. As shown in FIG. 6, the common electrode driver 17 is constituted by level adjusting circuits 17A and 17B which are connected in series between the power source terminal VDD of +5V and a ground terminal GND of 0V. The level adjusting circuit 17A sets the potential of the common electrode 22 at a high level VCOML of +4.5V when the polarity inversion signal POL is at +5V. The level adjusting circuit 17B sets the potential of the common electrode 22 at a low level VCOML of +0.5V when the polarity inversion signal POL is at 0V.

In the above-described liquid crystal panel 10, the X-driver 12 sequentially supplies the pixel signal voltage VSIG set at a level within the range of 0V to +5V according to the gray scale data of each pixel to the signal lines X1 to X1920 in each horizontal scanning period under the control of the liquid crystal controller 16, the Y-driver 14 supplies the scanning pulse to one of the scanning lines Y1 to Y480 which is sequentially changed every horizontal scanning period under the control of the liquid crystal controller 16, and the common electrode driver 17 supplies the common voltage VCOM to the common electrode 22 under the control of the liquid crystal controller 16. The pixel signal voltage VSIG and the common voltage VCOM are level-inverted every even-numbered horizontal scanning period in an odd-numbered frame period and also level-inverted every odd-numbered horizontal scanning period in an even-numbered frame period.

When all pixels are to be displayed in white corresponding to the maximum light transmittance, the pixel signal voltage VSIG is set, in an odd-numbered frame period, at +5V every odd-numbered horizontal scanning period and at 0V every even-numbered horizontal scanning period. In an even-numbered frame period, the pixel signal voltage VSIG is set at 0V every odd-numbered horizontal scanning period and at +5V every even-numbered horizontal scanning period. The common voltage VCOM is set, in an odd-numbered frame period, at +4.5V every odd-numbered horizontal scanning period and at +0.5V every even-numbered horizontal scanning period. In an even-numbered frame period, the common voltage VCOM is set at +0.5V every odd-numbered horizontal scanning period and at +4.5V every even-numbered horizontal scanning period.

When all pixels are to be displayed in black corresponding to the minimum light transmittance, the pixel signal voltage VSIG is set, in an odd-numbered frame period, at 0V every odd-numbered horizontal scanning period and at +5V every even-numbered horizontal scanning period. In an even-numbered frame period, the pixel signal voltage VSIG is set at +5V every odd-numbered horizontal scanning period and at 0V every even-numbered horizontal scanning period. The common voltage VCOM is set, in an odd-numbered frame period, at +4.5V every odd-numbered horizontal scanning period and at +0.5V every even-numbered horizontal scanning period. In an even-numbered frame period, the common voltage VCOM is set at +0.5V every odd-numbered horizontal scanning period and at +4.5V every even numbered horizontal scanning period.

Figure 7:
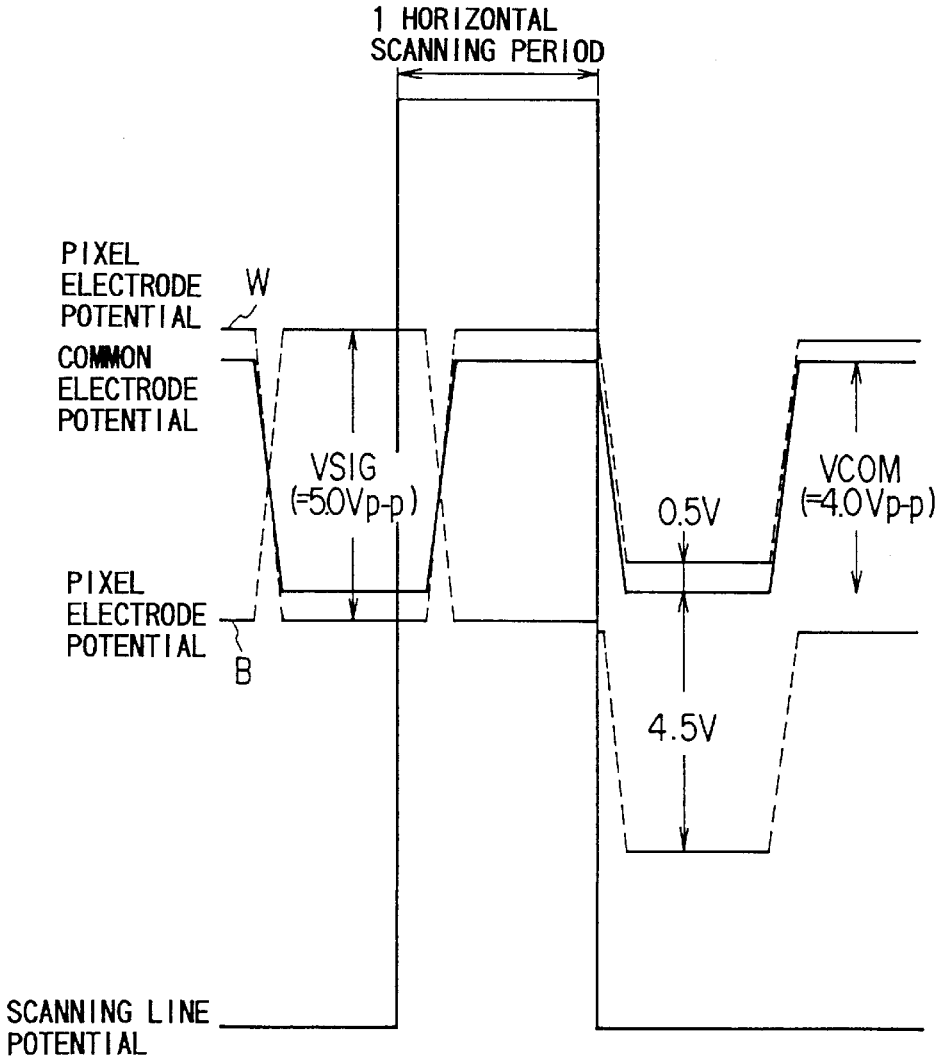
FIG. 7 is a chart showing waveforms so as to explain the potential relationship between a pixel electrode and a common electrode shown in FIG. 1.

FIG. 7 shows the potential relationship between the pixel electrode 20 of each pixel and the common electrode 22. In FIG. 7, W represents the potential of the pixel electrode 20 in displaying white, and B represents the potential of the pixel electrode 20 in displaying black. For example, in the first horizontal scanning period of the first frame period, a scanning pulse is supplied to the scanning line Y1. All the TFTs 24 connected to the scanning line Y1 are turned on in response to rising of the scanning pulse to supply the pixel signal voltage VSIG from the signal lines X1 to X1920 to the pixel electrodes 20 of the first row. With this operation, the potential of each pixel electrode 20 is set in accordance with the pixel signal voltage VSIG. More specifically, the potential of the pixel electrode 20 is set at +5V when the pixel signal voltage VSIG has a level for displaying white, or at 0V when the pixel signal voltage VSIG has a level for displaying black. The potential of the common electrode 22 is set at +4.5V by the common voltage VCOM in the first horizontal scanning period of the first frame period. The liquid crystal capacitance CLC and the storage capacitance CS are charged in accordance with the potential difference between the pixel electrode 20 and the common electrode 22 to apply an electric field corresponding to the potential difference to the liquid crystal cell. When the scanning pulse falls, all the TFTs 24 connected to the scanning line Y1 are turned off, thereby causing the pixel electrodes 20 of the first row to be electrically disconnected from the signal lines X1 to X1920, i.e., set in a floating state. With this operation, the potential difference between the pixel electrode 20 and the common electrode 22 is maintained by the liquid crystal capacitance CLC and the storage capacitance CS. In the second horizontal scanning period of the first frame period, the potential of the common electrode 20 is lowered by 4V from +4.5V and set at +0.5V upon level inversion of the common voltage VCOM. At this time, since the pixel electrode 20 is in the floating state, the potential of the pixel electrode 20 lowers by 4V due to the potential drop of the common electrode 20. However, the potential difference between the pixel electrode 20 and the common electrode 22 does not change. For this reason, the electric field corresponding to the potential difference is continuously applied to the liquid crystal cell LC until all the TFTs 24 connected to the scanning line Y1 are turned on again in the first horizontal scanning period of the second frame period.

When each TFT 24 is actually turned off to set the pixel electrode 20 in the floating state, the charge is redistributed not only to the liquid crystal capacitance CLC and the storage capacitance CS but also the parasitic capacitances between the pixel electrode 20 and the scanning line and between the pixel electrode 20 and the TFT 24. Consequently, the potential of the pixel electrode 20 drops in correspondence with the amount of changes extracted from the pixel electrode 20. This causes the potential difference between the pixel electrode 20 and the common electrode 22 to slightly vary between the display of white and the display of black. For this reason, the center level of the amplitude of the common voltage VCOM is preferably lowered in correspondence with the potential drop amount of the pixel electrode 20 due to charge extraction. When the amplitude of the common voltage VCOM is selected to be smaller than that of the pixel signal voltage VSIG to set the low level VCOML of the common voltage VCOM at 0V, the level adjusting circuit 17B can be constituted only by a simple switching element for electrically connecting the ground terminal GND to the common electrode 22 when the polarity inversion signal POL is at 0V.

According to the above-described embodiment, the common voltage VCOM has an amplitude (=4 Vp-p) smaller than the amplitude (=5 Vp-p) of the pixel signal voltage VSIG, and is level-inverted within the range from the minimum level (=0V) to the maximum level (=+5V) of the amplitude of the pixel signal voltage VSIG. For this reason, the common electrode driver 17 and the X-driver 12 are commonly connected between the power source terminal VDD and the ground terminal GND to respectively obtain the common voltage VCOM and the pixel signal voltage VSIG. Therefore, the required number of stable power source voltage levels to be supplied from the DC/DC converter 18 to the common electrode driver 17 and the X-driver 12 is reduced to ½, so that the displaying device can be manufactured at a low cost. The power consumption is also reduced because the amplitude (=4 Vp-p) of the common voltage VCOM is smaller than the conventional amplitude (=5.4 Vp-p). In addition, when the level adjusting circuit 17B is simplified by setting the low level VCOML of the common voltage VCOM at0V, as described above, a more inexpensive displaying device with a smaller frame and lower profile can be realized. When the amplitude of the common voltage VCOM is determined as described above, flicker can be sufficiently suppressed even in the liquid crystal panel 10 having a large diagonal size of 12 inches or more.

In this embodiment, the liquid crystal panel 10 is of a normally white type. Therefore, the potential of the pixel electrode 20 corresponding to a pixel with the maximum light transmittance (white display) and that of the pixel electrode 20 corresponding to a pixel with a light transmittance other than the maximum light transmittance are reversed with reference to the potential of the common electrode 22. When the liquid crystal panel 10 is a normally black type, the potential of the pixel electrode 20 corresponding to a pixel with the minimum light transmittance (black display) and that of the pixel electrode 20 corresponding to a pixel with a light transmittance other than the minimum light transmittance are reversed with reference to the potential of the common electrode 22. Such a potential relationship reduces the amount of a shift in the potential of the pixel electrode 20 in the floating state, which changes upon level inversion of the common voltage VCOM due to the parasitic capacitance of the pixel electrode 20, and accordingly, reduces the amount of a shift in the gate voltage required for switching the TFT 24. Therefore, the VOFF level and the VON level are set at −12V and +19V, respectively, in this embodiment. In this case, the electrical stress on the liquid crystal cell LC is decreased so that the reliability of the displaying operation is improved. The difference between the VOFF level and the VON level becomes smaller than that of the prior art. Since this allows the DC/DC converter 18 to be constituted by components with smaller sizes, a more inexpensive displaying device with a smaller frame and lower profile can be realized.

In this embodiment, the voltage polarity between the pixel electrode 20 and the common electrode 22 is set to change depending on the display gray scale level. For example, when display in black or halftone is performed in the selection period shown in FIG. 7, the pixel electrode potential is set on the lower potential side with respect to the common electrode potential. For display in white, the pixel electrode potential is set on the higher potential side with respect to the common electrode potential. That is, regardless of frame inversion driving, polarity inversion is not performed for a specific display gray scale level. However, it is rare that the DC voltage is continuously applied to the liquid crystal in an ordinary displaying operation, so no problem of reliability is posed at all.

Figure 8:
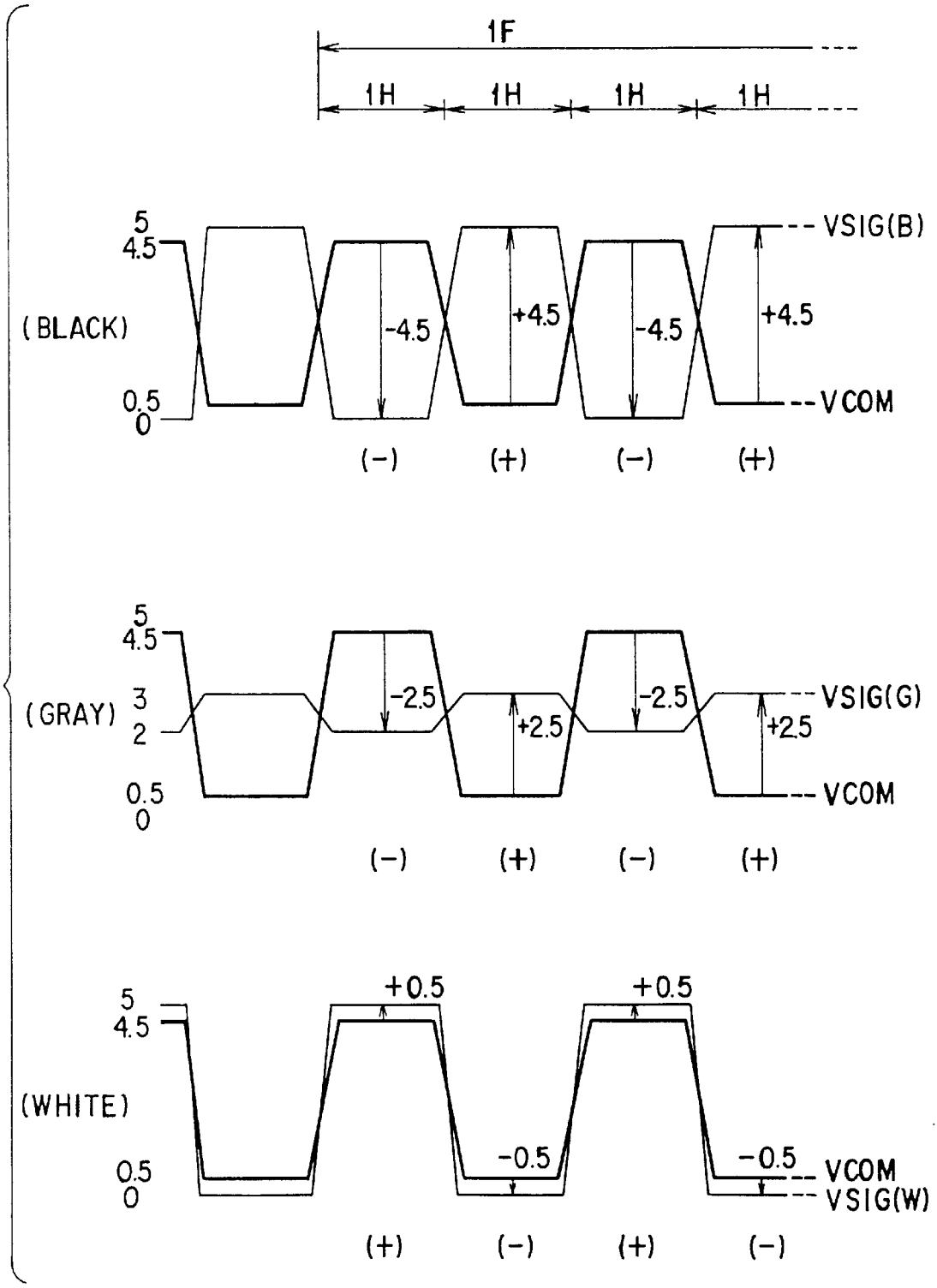
FIG. 8 is a chart of waveforms so as to explain the transitions of pixel signal and common voltages which are generated to keep the display gray scale in black, gray, and white in the liquid crystal panel shown in FIG. 1, and a polarity change relative to these voltages for a plurality of horizontal scanning periods.
Figure 9:
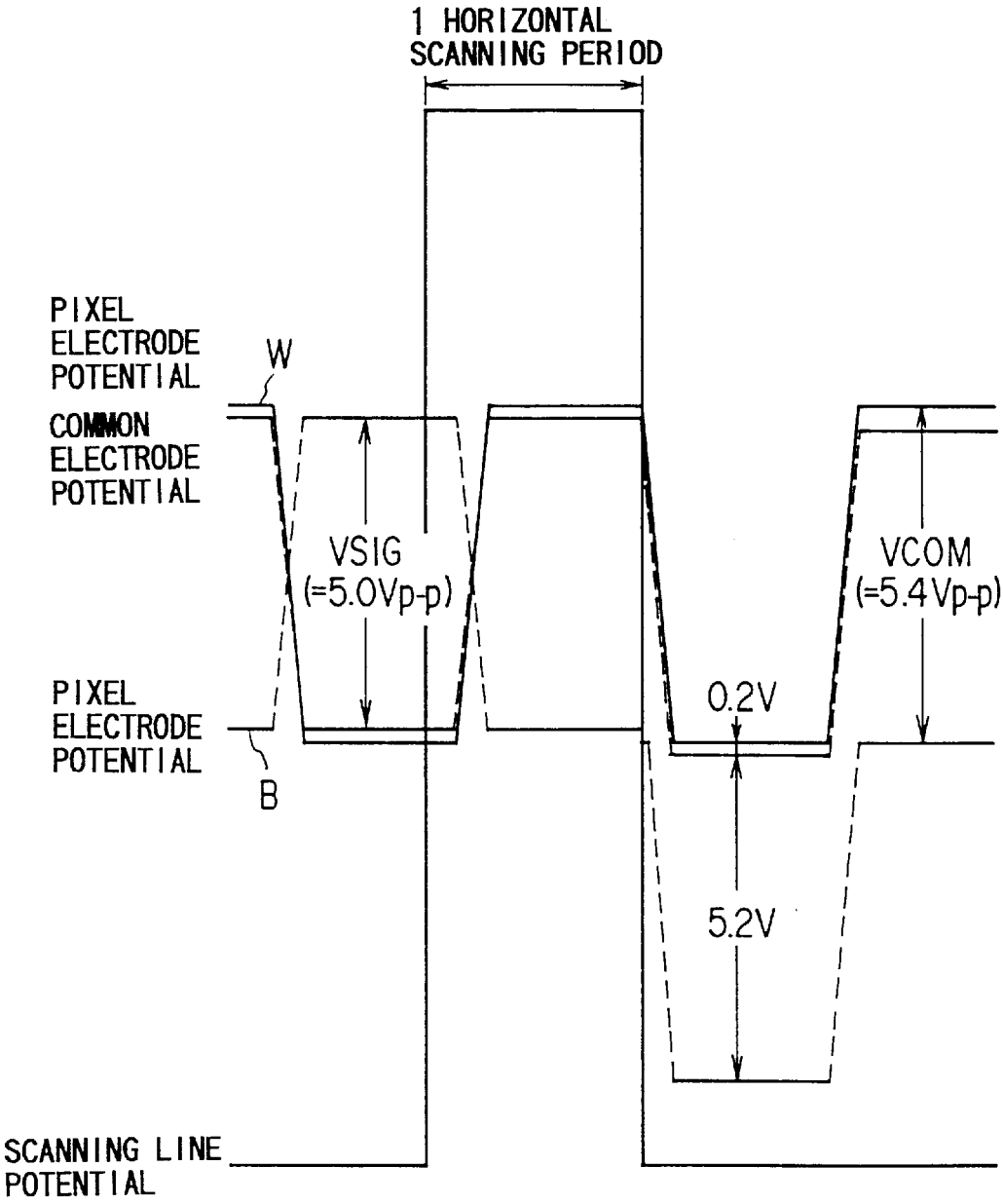
FIG. 9 (PRIOR ART)
FIG. 9 is a chart showing waveforms so as to explain the potential relationship between a pixel electrode and a common electrode in a conventional liquid crystal displaying device.

In the liquid crystal panel 10 of a normally white type, the pixel signal voltage VSIG and the common voltage VCOM which are generated to keep the display gray scale at black, gray (halftone), or white are level-inverted every horizontal scanning period and transit, as shown in FIG. 8. This relative polarity change will be described below in more detail. For example, in the first horizontal scanning period, the difference between the pixel signal voltage VSIG and the common voltage VCOM has a negative polarity in the display gray scale for black and gray, and a positive polarity in the display gray scale for white. In the second horizontal scanning period, the difference between the pixel signal voltage VSIG and the common voltage VCOM has a positive polarity in the display gray scale for black and gray, and a negative polarity in the display gray scale for white. When the display gray scale changes from black to white in the first and second horizontal scanning periods, no polarity inversion occurs. More specifically, in the liquid crystal panel 10, the polarity can be inverted every predetermined period except for a case wherein a specific gray scale range including a gray scale level corresponding to, e.g., the minimum optical modulation ratio is selected for displaying. When the voltage polarity is not inverted, the direction of an electric field in the liquid crystal cell LC is not inverted either. However, this noninversion of the direction of the electric field occurs at random depending on the change in display gray scale level, and therefore can be maintained at an admissible frequency which does not adversely affect reduction of flicker, by limiting the specific gray scale range. The specific gray scale range can be limited to, e.g., the display gray scale level for white, and more strictly, set to be $|VWmin|<(|VEp\text{-}p-|VCOMp\text{-}p|)<|VWmax|$ (FIG. 5), where $|VEp\text{-}p|-|VCOMp\text{-}p|$ is the voltage applied to the liquid crystal, i.e., the potential difference between the pixel electrode and the common electrode, $|VWmin|$ is the minimum value of the voltage applied to the liquid crystal corresponding to the white gray scale level, and $|VWmax|$ is the maximum value of the voltage applied to the liquid crystal corresponding to the white gray scale level. Although the potential VEp-p of the pixel electrode changes due to the parasitic capacitance of the pixel electrode 20 when the pixel electrode 20 is set in the floating state after application of the pixel signal voltage VSIG, the relationship between the potential VEp-p and the pixel signal voltage VSIG can be measured. Therefore, the direction of the electric field in the liquid crystal cell LC can be properly controlled on the basis of the pixel signal voltage VSIG and the common voltage VCOM.

As a result, the amplitude of the common voltage VCOM can be determined to be smaller than that set when the direction of the electric field in the liquid crystal cell LC is inverted over the entire gray scale range. This reduces the power consumption and distortion in the common voltage waveform generated in a larger displaying device. When the number of pixel electrodes is increased to obtain the larger displaying device, the common electrode driver 17 must drive, as a load, the common electrode whose area is increased in proportion to the number of pixel electrodes. This makes it difficult to smoothly transit the common voltage VCOM from one of the minimum level and the maximum level to the other. However, in the above-described liquid crystal panel 10, since the amplitude of the common voltage VCOM can be determined to be small, distortion in the common voltage VCOM can be minimized even in the larger displaying device.

In the above-described embodiment, the amplitude of the common voltage is limited in the range from the minimum level to the maximum level of the pixel signal voltage in order to reduce the required number of stable power source voltage levels. However, giving prominence to facilitation of reduction of flicker, the above-described specific gray scale range may be set within the range of the first gray scale level to the (n−2)-th gray scale level where n is the total number of gray scale levels (n: positive integer). Alternatively, this range may be set from the first gray scale level to the (n/2)-th gray scale level or from the (n/2)-th gray scale level to the (n−2)-th gray scale level. The specific gray scale range is preferably set to be the first gray scale level or the n-th gray scale level.

The liquid crystal panel 10 of this embodiment is constituted using a typical liquid crystal. The liquid crystal panel 10 can also be constituted using a liquid crystal with a low threshold voltage of about 3V. In this case, only the amplitude of the common voltage VCOM need be adjusted, and that of the pixel signal voltage VSIG need not be adjusted. That is, a driver IC with a withstand voltage of 5V can be used as the X-driver 12, like the prior art.

The present invention is not limited to the above embodiment, and various changes and modifications can be made within the spirit and scope of the invention.

I claim:

1. A displaying device comprising:

an array substrate on which a plurality of pixel electrodes are arrayed;

a common electrode arranged in association with the pixel electrodes;

an optical modulation layer set to have an optical modulation ratio corresponding to a potential difference between each pixel electrode and the common electrode; and a display control circuit for controlling the potential difference between each pixel electrode and the common electrode;

wherein the display control circuit includes:

a pixel electrode driving unit for supplying a pixel signal voltage to each pixel electrode to set a display gray scale level every predetermined period; and a common electrode driving unit for supplying a common voltage to the common electrode every predetermined period a relationship between the pixel signal voltage and the common voltage being determined such that an electric field in the optical modulation layer depends on the display gray scale level in the predetermined period; and wherein the relationship between the pixel signal voltage and the common voltage is determined such that the direction of the electric field in the optical modulation layer in a range from a first gray scale level to an (n−2)-th gray scale level is reversed to that in a remaining gray scale range where n is a total number of gray scale levels (n: positive integer).

2. A displaying device comprising:

an array substrate on which a plurality of pixel electrodes are arrayed;

a common electrode arranged in association with the pixel electrodes;

an optical modulation layer set to have an optical modulation ratio corresponding to a potential difference between each pixel electrode and the common electrode; and a display control circuit for controlling the potential difference between each pixel electrode and the common electrode;

wherein said display control circuit includes:

a pixel electrode driving unit for supplying a pixel signal voltage to each pixel electrode to set a display gray scale level every predetermined period; and a common electrode driving unit for supplying a common voltage to the common electrode every predetermined period, a relationship between the pixel signal voltage and the common voltage being determined such that an electric field in the optical modulation layer depends on the display gray scale level in the predetermined period; and wherein the relationship between the pixel signal voltage and the common voltage is determined such that the direction of the electric field in said optical modulation layer in one of a range from a first gray scale level to an (n/2)-th gray scale level and a range from the (n/2)-th gray scale level to an (n−2)-th gray scale level is reversed to that in a remaining gray scale range where n is a total number of gray scale levels (n: positive integer).

3. A displaying device comprising:

an array substrate on which a plurality of pixel electrodes are arrayed;

a common electrode arranged in association with the pixel electrodes;

an optical modulation layer set to have an optical modulation ratio corresponding to a potential difference between each pixel electrode and the common electrode; and a display control circuit for controlling the potential difference between each pixel electrode and the common electrode;

wherein said display control circuit includes:

a pixel electrode driving unit for supplying a pixel signal voltage to each pixel electrode to set a display gray scale level every predetermined period; and a common electrode driving unit for supplying a common voltage to the common electrode every predetermined period, a relationship between the pixel signal voltage and the common voltage being determined such that an electric field in the optical modulation layer depends on the display gray scale level in the predetermined period; and wherein the relationship between the pixel signal voltage and the common voltage is determined such that the direction of the electric field in said optical modulation layer in one of a first gray scale level and an n-th gray scale level is reversed to that in a remaining gray scale level where n is a total number of gray scale levels (n: positive integer).

4. A displaying device comprising:

an array substrate on which a plurality of pixel electrodes are arrayed;

a common electrode arranged in association with the pixel electrodes;

an optical modulation layer set to have an optical modulation ratio corresponding to a potential difference between each pixel electrode and the common electrode; and a display control circuit for controlling the potential difference between each pixel electrode and the common electrode;

wherein said display control circuit includes:

a pixel electrode driving unit for supplying a pixel signal voltage to each pixel electrode to set a display gray scale level every predetermined period; and a common electrode driving unit for supplying a common voltage to the common electrode every predetermined period, a relationship between the pixel signal voltage and the common voltage being determined such that an electric field in the optical modulation layer depends on the display gray scale level in the predetermined period;

wherein the relationship between the pixel signal voltage and the common voltage is determined such that the direction of the electric field in said optical modulation layer in one of a first gray scale level and an n-th gray scale level is reversed to that in a remaining gray scale level where n is a total number of gray scale levels (n: positive integer); and wherein said optical modulation layer is a liquid crystal layer of a normally white type for displaying a brightest image as the first gray scale level when the potential difference between the pixel electrode and said common electrode is substantially zero, and the relationship between the pixel signal voltage and the common voltage is determined such that the direction of the electric field in said liquid crystal layer only in the first gray scale level is reversed to that in the remaining gray scale level.

5. A displaying device comprising:

an array substrate on which a plurality of pixel electrodes are arrayed;

a common electrode arranged in association with said pixel electrodes;

an optical modulation layer set to have an optical modulation ratio corresponding to a potential difference between each pixel electrode and said common electrode; and a display control circuit for controlling the potential difference between each pixel electrode and said common electrode to periodically inverting an electric field in said optical modulation layer;

wherein said display control circuit includes:

a pixel electrode driving unit for level-inverting a pixel signal voltage of a first amplitude every predetermined period and supplying the pixel signal voltage to each pixel electrode to set a display gray scale level, and a common electrode driving unit for level-inverting a common voltage of a second amplitude in synchronism with level inversion of the pixel signal voltage and supplying the common voltage to the common electrode, the first and second amplitudes being determined such that a voltage polarity of the difference between the pixel signal voltage and the common voltage is inverted every predetermined period except when a specific gray scale range including a gray scale level corresponding to a minimum optical modulation ratio is selected for displaying.

6. A displaying device comprising:

an array substrate having a plurality of pixel electrodes arrayed thereon;

a common electrode arranged in association with said pixel electrodes;

an optical modulation layer positioned in the vicinity of said common electrode and adapted to have an optical modulation ratio corresponding to a potential difference between each pixel electrode and said common electrode; and a display control circuit controlling the potential difference between each pixel electrode and said common electrode and periodically inverting an electric field in said optical modulation layer;

wherein said display control circuit includes:

a pixel electrode driving unit level-inverting a pixel signal voltage having a first amplitude every predetermined period and supplying the pixel signal voltage to each pixel electrode to set a display gray scale level; and a common electrode driving unit level-inverting a common voltage having a second amplitude in synchronism with the level inversion of the pixel signal voltage and supplying the common voltage to the common electrode, the second amplitude (i) being predetermined to be smaller than the first amplitude and (ii) not exceeding a range from a minimum level to a maximum level of the pixel signal voltage;

wherein a voltage polarity of the difference between the pixel signal voltage and the common voltage is determined based on the display gray scale level.

7. A device according to claim 6, wherein a minimum level of the common voltage is determined to be equal to that of the pixel signal voltage.

8. A device according to claim 6, wherein a minimum level of the common voltage is determined to be higher than that of the pixel signal voltage.

9. A device according to claim 6, wherein said display control circuit further includes a power source circuit for generating a stable power source voltage which is shared by said pixel electrode driving unit and said common electrode driving unit to obtain the pixel signal voltage and the common voltage, respectively.

10. A displaying device comprising:

an array substrate having a plurality of pixel electrodes arrayed thereon;

a common electrode arranged in association with said pixel electrodes;

an optical modulation layer positioned in the vicinity of said common electrode and adapted to have an optical modulation ratio corresponding to a potential difference between each pixel electrode and said common electrode; and a display control circuit controlling the potential difference between each pixel electrode and said common electrode;

wherein said display control circuit includes:

a pixel electrode driving unit supplying a pixel signal voltage to each pixel electrode to set a display gray scale level; and a common electrode driving unit supplying a common voltage to the common electrode, the common voltage having an amplitude smaller than an amplitude of the pixel signal voltage;

wherein the pixel signal voltage and the common voltage are each level-inverted in a predetermined manner during a number of predetermined periods; and wherein a voltage polarity of the difference between the pixel signal voltage and the common voltage is determined based on the display gray scale level.

* * * * *